United States Patent [19]

Glazer

[11] 4,403,137

[45] Sep. 6, 1983

[54] METHOD OF HEATING A BODY OF LIQUID AND A WATER HEATING UNIT FOR TANKS UTILIZING SUCH METHOD

[76] Inventor: Yitzhak Glazer, 31 Kaplansky St., Rishon-Lezion, Israel

[21] Appl. No.: 325,341

[22] Filed: Nov. 27, 1981

[30] Foreign Application Priority Data

Dec. 11, 1980 [IL] Israel ..... 61694

[51] Int. Cl.[3] ..... F24H 1/18; H05B 3/78

[52] U.S. Cl. ..... 219/306; 219/312; 219/314; 219/316

[58] Field of Search ..... 219/306, 307, 310, 312, 219/316, 319, 314, 523; 165/104.19; 126/360 A, 360 R, 367, 368

[56] References Cited

U.S. PATENT DOCUMENTS

| | | | |
|---|---|---|---|
| 2,026,809 | 1/1936 | Winn | 219/306 |
| 2,736,790 | 2/1956 | Alexander | 219/314 |
| 4,007,371 | 2/1977 | Njos | 219/523 |

FOREIGN PATENT DOCUMENTS

| | | | |
|---|---|---|---|
| 508866 | of 0000 | United Kingdom | 219/314 |

*Primary Examiner*—B. A. Reynolds
*Assistant Examiner*—Teresa J. Walberg
*Attorney, Agent, or Firm*—Ostrolenk, Faber, Gerb & Soffen

[57] ABSTRACT

For heating a body of liquid, such as water within a domestic water tank, there is provided an elongated hollow tube extending at an angle with respect to the vertical from the bottom to the upper region or level of the water. The tube is closed at its bottom and open at its top. A series of openings are formed along the lowermost generatrix of the tube. Heating the water inside the lower region of the tube will cause a thermal circulation whereby warmed water will rise along the uppermost generatrix of the tube, and cold water will enter through the openings, flow first downwards and, after getting warmer, rise with the warm water upwards flow. The upper region of the body of water will thus become more intensively heated than the rest of the water.

10 Claims, 9 Drawing Figures

FIG.1
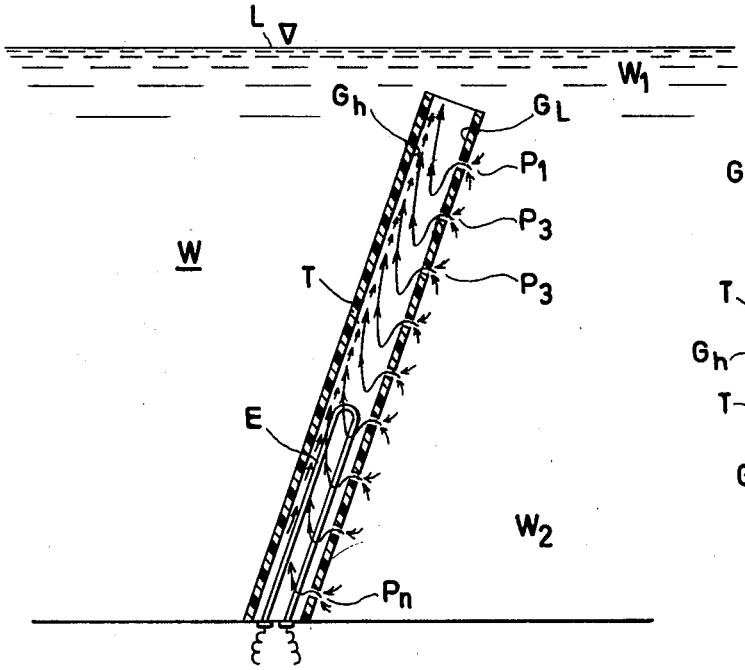
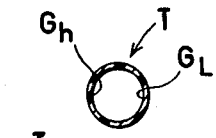
FIG.1a
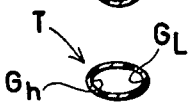
FIG.1b
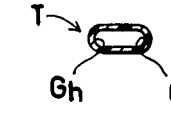
FIG.1c
FIG. 2
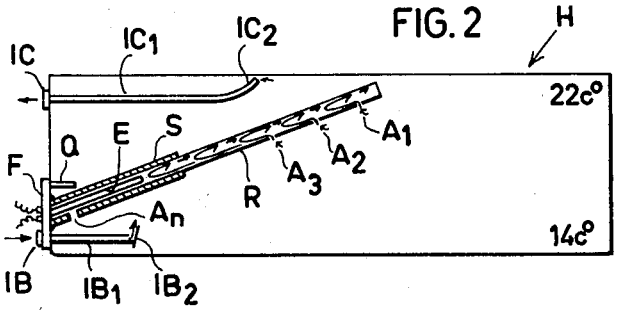
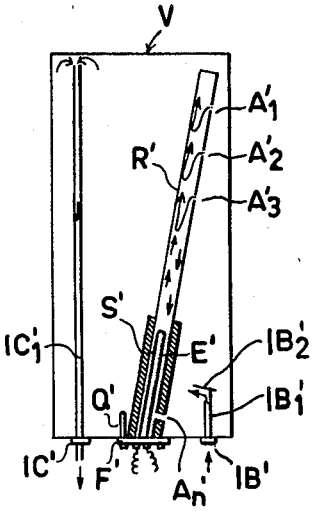
FIG.4
FIG.3
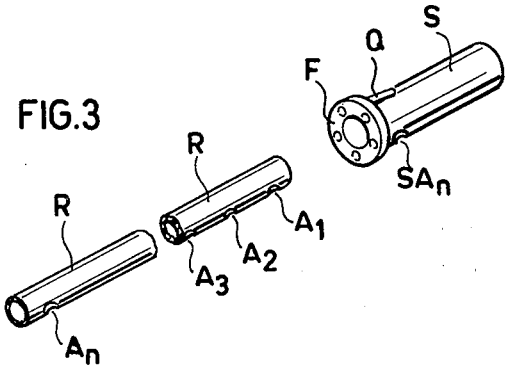

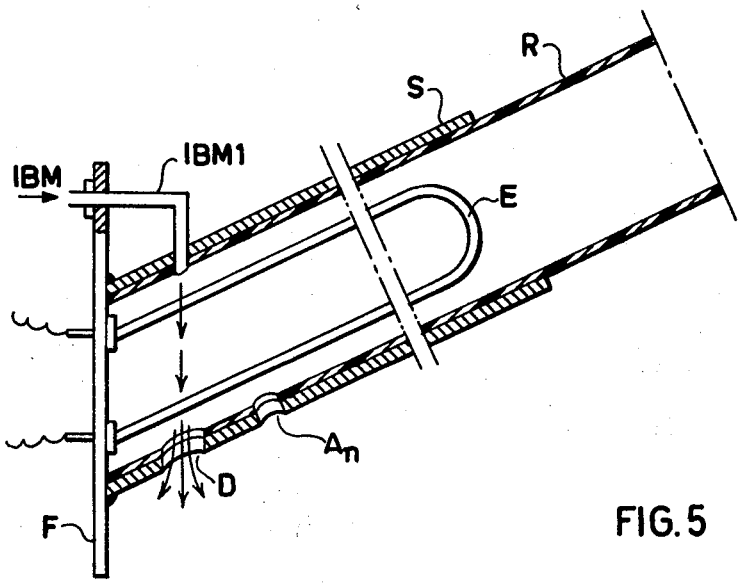
FIG. 5
FIG. 6
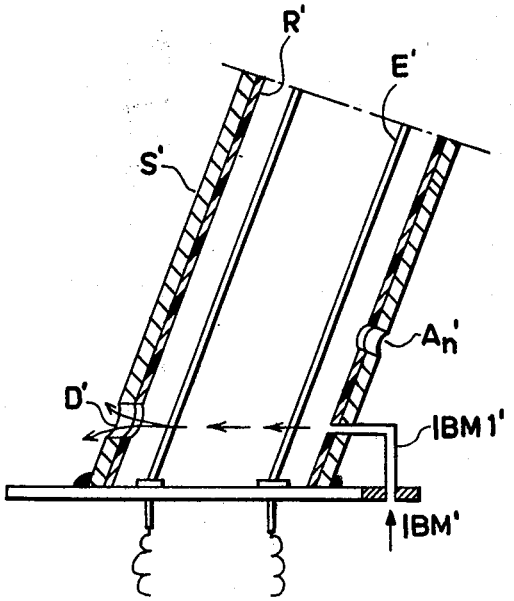

METHOD OF HEATING A BODY OF LIQUID AND A WATER HEATING UNIT FOR TANKS UTILIZING SUCH METHOD

This invention relates to a water heating method and installation, particularly applicable for domestic water tanks, whether installed within an apartment or on the roof as a part of the solar energy system.

Conventional water heating tanks are provided with a thermostatically controlled electric heating element provided at the bottom of the tank. For consumption of heated water it is therefore necessary to heat-up to the required temperature relatively large quantities of water, namely almost all of the volume of the tank, before satisfactorily warm water can be used. In case of small and piecemeal consumption of water, this requirement drastically reduces the overall efficiency of the system.

Various solutions have been suggested to cure this deficiency of conventional electrically heated water tanks, such as Israel Patent No. 16824 or my co-pending Israel Patent Application No. 59575.

It is the object of this invention to provide another, more effective and simple solution to this problem.

It is a further object of the present invention to provide an electrical water heating unit readily adapted to be installed in domestic water heating tanks of the type referred to, as a replacement to the existing heating element, requiring only minor changes in the structure of such conventional tanks.

It is a still further object of the invention to make use of the well-known fact that, normally, water stored in electric water heaters or back-up tanks for solar installations, are warmer by about 4°–7° C. at the upper region thereof than at the bottom, where the cold mains water is supplied.

Therefore, concentrating the heating energy on the already warmer water rather than to heat up water located at the bottom of the tank, brings about a considerable saving of energy.

All these features, together with the extreme simplicity of design and construction of the novel device, and the easy replacing method of the existing conventional heating elements, makes the instant invention most attractive and superior over other specific solutions suggested heretofore for the same purposes.

According to one aspect of the present invention there is provided a method of heating a body of liquid more intensively at a higher region than at a lower region thereof comprising the steps of immersing in the body of liquid an elongated hollow tube, extending at an angle with respect to the vertical, the tube having an open top located at the upper region of the body of the liquid, a closed bottom, and a series of openings formed along the lowermost generatrix line of the tube communicating between the liquid exterior of the tube and the interior thereof, and heating the liquid contained at the lower region of the tube so that thermal circulation is generated wherein warmed liquid flows upwards along the uppermost generatrix and cold liquid flows through the openings and downwards along the lower generatrix of the tube.

According to another aspect of the invention there is provided an electric water unit, particularly for domestic water tanks, comprising an open top, and closed bottom elongated hollow tube mounted on a lower section of the tank and extending up to an upper section thereof at an angle with respect to the vertical, a heating element installed within the tube at the lower section thereof, and a series of openings formed along the lowermost generatrix of the tube so that thermal circulation is generated wherein warm liquid flows through the openings and downwards along the lowermost generatrix of the tube.

These and further features and advantages of the present invention will become more fully understood in the light of the ensuing description of two preferred embodiments of the invention, given by way of example only, with reference to the accompanying drawings, wherein—

FIG. 1 is a schematic illustration of the method according to the present invention;

FIGS. 1*a*, 1*b* and 1*c* show different cross-sectional profiles of the tube shown in FIG. 1;

FIG. 2 shows the application of the method in a horizontally positioned domestic water tank;

FIG. 3 is an exploded view of the pipe-sleeve and the pipe of FIG. 2;

FIG. 4 shows the application and the invention to a vertically mounted water heating tank;

FIG. 5 shows the connection of the water inlet according to an additional aspect of the invention; and FIG. 6 shows such connection in a vertical tank.

In FIG. 1 there is schematically shown a body of a liquid, such as water, marked W, with respect to which it is intended to locally warm-up more intensively water at the region marked $W_1$, than at the remaining lower level $W_2$. It should be here and now emphasized that although, due to the natural thermosyphonic circulation, water heated at any region tend to rise and accumulate at the highest level thereof, such circulation involves the admixing of the hot water with the colder, surrounding water; therefore, as known, in order to obtain water of specific high temperature at the upper level of the body of liquid, substantially the whole bulk of the liquid would have to be warmed, thereby investing a large quantity of energy which is not actually required for the purposes of having a small quantity of warm water near the upper level of the water body.

Now, therefore, the major principle of the invention is to pick-up water from a location as-high-as possible, have this picked-up quantity of water intensively heated by the heating element which is located at a lower level, and send it back upwards as-far-as possible, to the location where it is needed. This goal is achieved in the following manner. A hollow elongated tube T is positioned in the water, tilted at a certain angle with respect to the vertical, as shown. A series of openings $P_1$, $P_2$, $P_3$ . . . , $P_n$ are formed at the lowermost generatrix line $G_l$ of the tube, namely, the extreme right-hand side thereof. The tube T extends substantially up to the level L of the liquid. A heating element such as the electric immersion heater element E is installed at the bottom of the tube T. Due to the provision of the openings P and the tilted position of the tube T, an internal circulation is obtained as schematically shown by the arrows, namely, a continuous flow of heated water is developed along the uppermost generatrix $G_h$ of the tube T, whereas water sucked through the openings P will tend first to descend due to their higher specific gravity, and then drift upwards with the current of heated water flowing upwards along the left-hand side of the interior of the tube.

Experiments with the device constructed as shown in FIG. 1 have proved that it would suffice to provide only one, two or three openings $P_1$, $P_2$, $P_3$ at the upper section of the tube T so that mainly already somewhat heated water will participate in the circulation within the tube, which feature is one of the major advantages of the invention. The provision of the lower-most opening $P_n$ is mainly required at the beginning of the operation or where the whole body of water has become heated to substantially the same temperature.

As shown in FIGS. $1_a$, $1_b$ and $1_c$ the cross-sectional profile of the tube T need not be circular, and many other profiles may be chosen while the thermal circulation within such cross-sections will adapt itself to the shape and dimensions of the tube, namely a downstream current at one side along the line $G_l$ and an upwards flow of heated water at the opposite side along $G_h$.

Turning now to FIG. 2 there is schematically shown a horizontally positioned conventional water heater tank H wherein the heating unit is constructed according to the principles of the method so far described. Hence, there is provided a cold water inlet IB and heated water outlet IC as in conventional boilers, namely, inlet IB includes a pipe section $IB_1$ extending a small distance into the tank with a deflector $IB_2$ at its end, and outlet IC has a pipe section $IC_1$ with an upwardly bent portion $IC_2$ so that the water is taken from the highest location of the tank.

The heating unit proper comprises a mounting flange F, including a thermostat Q, adapated to be fastened to the wall of the tank by bolts (not shown). A metal sleeve S is attached—as by welding—to the flange F, extending at an angle with respect thereto. As more clearly seen in FIG. 3, an opening $SA_n$ is formed at the lower, downwardly facing wall of the sleeve S, so that after the insertion of a pipe R—which is provided with series of openings $A_1$, $A_2$, $A_3$ and $A_n$ as shown—will be in register with the opening $A_n$ while the top of the pipe R reaches to the top of the tank H (FIG. 2).

To complete the assembly of the heating installation, an electric immersion heating element E is inserted into the sleeve S and sealed in the conventional manner.

The operation of the water heater is the same as already described in connection of FIG. 1, namely, that water from the upper region of the tank (which normally is already warmed up, say, to 22° C. compared with a temperature of 14° C. of the mains water) will circulate within the pipe R as denoted by the arrows in FIG. 2.

The embodiment of FIG. 4, namely the application of the invention to vertical boilers V is analogous to that of FIG. 2, and the same reference symbols are therefore used, without further explanation.

It will be understood by those skilled in the art that making the pipe R of a thermoplastic material such as polypropylene, which possesses heat insulating properties, solves the serious problem of building up of sediments and no corrosion can take place. The metal sleeve may be protected as usual by a magnesium body attached thereto, (not shown) as known in the art.

However, it has been found advisable, in order to more effectively solve the problem of the formation of scale and sediments at the bottom of the sleeve S and the inside of the flange F, to connect the inlet directly to the sleeve S—rather than having the water flowing freely into the tank; hence, as shown in FIGS. 5 and 6, the modified inlets IBM and IBM' have their pipe sections $IBM_1$ connected to the inside of the pipes R, R'; openings D, D' are provided at the opposite side as shown so that the incoming water will transverse through the sleeve S and thereby flush out all sediments and particles that otherwise would have settled on the flange inner surface.

It is believed that the application of the heating method according to the present invention, namely the internal circulation within a tilted, completely immersed, open-top and closed-bottom tube, paves the way to many other applications and possibilities novel per-se and presenting significant advantages over any other known device.

What is claimed is:

1. A method of heating a body of liquid more intensively at a higher region than at a lower region thereof comprising the steps of:

immersing in the body of liquid an elongated hollow tube, extending at an angle with respect to the vertical, the tube having an open top located at the upper region of the body of the liquid, a closed bottom, and a series of openings formed along the lowermost generatrix line of the tube communicating between the liquid exterior of the tube and the interior thereof; and heating the liquid contained at the lower region of the tube so that thermal circulation is generated wherein warmed liquid flows upwards along the uppermost generatrix and cold liquid flows through the openings and downwards along the lower generatrix of the tube.

2. The method as claimed in claim 1 wherein the tube is made of a heat insulating material.

3. The method as claimed in claim 2 wherein the cross-section of the tube is circular.

4. The method as claimed in claim 1 wherein the openings are provided only near the top of the tube.

5. The method as claimed in claim 4 wherein an additional opening is provided near the bottom of the tube.

6. An electric water heater unit, particularly for domestic water tanks, comprising an open top and closed bottom, elongated hollow tube mounted on a lower section of the tank and extending up to an upper section thereof at an angle with respect to the vertical, a heating element installed within the tube at the lower section thereof, and a series of openings formed along the lowermost generatrix of the tube so that thermal circulation is generated wherein warm liquid flows upwards along the uppermost generatrix and cold liquid flows through the openings and downwards along the lowermost generatrix of the tube.

7. The unit as claimed in claim 6 further comprising a mounting sleeve with a flange adapted to be fixed to the tank wall, and a pipe constituting said tube passing through the sleeve.

8. The unit as claimed in claim 7 wherein said pipe is made of a heat insulating material.

9. The unit as claimed in claim 8 wherein an additional first opening is provided near the bottom of the pipe through said sleeve.

10. The unit as claimed in claim 9 wherein cold water supply is connected to the said additional first opening, and an additional second opening is provided at an opposite side of the pipe and sleeve so that cold incoming water is flushed through the pipe in a generally diametrical direction.

* * * * *